US005769183A

United States Patent [19]

Richter et al.

[11] Patent Number: 5,769,183

[45] Date of Patent: Jun. 23, 1998

[54] DRIVE UNIT FOR A SELF-PROPELLED ELEVATOR CAR

[75] Inventors: Utz Richter, Ebikon; Christoph Liebetrau, Menziken, both of Switzerland; Albrecht Morlock, Horb, Germany; Helmut Heizmann, Stuttgart, Germany; Ortwin Piper, Schwieberdingen, Germany

[73] Assignee: Inventio AG, Hergiswill, Switzerland

[21] Appl. No.: 656,057

[22] Filed: May 31, 1996

[30] Foreign Application Priority Data

Jun. 2, 1995 [CH] Switzerland ..... 01623/95

[51] Int. Cl.[6] ..... B66B 9/00

[52] U.S. Cl. ..... 187/249; 187/270

[58] Field of Search ..... 187/239, 249, 187/250, 270, 277, 409, 410, 902, 350

[56] References Cited

U.S. PATENT DOCUMENTS 3,924,710 12/1975 Shohet ..... 187/270

FOREIGN PATENT DOCUMENTS 0330809 9/1989 European Pat. Off. .
3523187 1/1987 Germany .
956332 4/1964 United Kingdom .

*Primary Examiner*—Kenneth Noland
*Attorney, Agent, or Firm*—William J. Clemens

[57] ABSTRACT

A drive unit (1,41,51) for a self-propelled elevator car (30) which travels along a pair of guide rails (27) is connected with a car-supporting structure (16) by rocker arms (15) and contact pressure springs (29). An electric motor (2,3,26,31) is coaxial with a wheel shaft (8) which extends therethrough and has a pair of drive wheels (10) mounted at the ends thereof. The motor housing (31) is connected to the axle tubes (11) by releasably attached motor flanges (12). The motor (2,3,26,31) drives the wheel axle (8) in rotation through a speed-reducing planetary gear (33) and a brake (32,34) which prevents rotation of the wheel axle (8) can be released selectively. An auxiliary drive (35,36,37) mounted on the motor (2,3,26,31) selectively rotates the wheel axle (8) in response to a power failure.

19 Claims, 3 Drawing Sheets

DRIVE UNIT FOR A SELF-PROPELLED ELEVATOR CAR

BACKGROUND OF THE INVENTION

The present invention relates generally to self-propelled elevators and, in particular, to a drive unit for a self-propelled elevator car.

The UK patent specification No. 956 332 shows a drive for a self-propelled elevator car with different variations being shown in the FIGS. 9 to 13. A common feature of the variations illustrated is a motor with one or two shaft ends on which a worm is formed. The worm or worms rotate worm wheels which are flanged together with drive wheels. In a configuration where the drive wheels extend from only one side of the car, the drive is disposed below the car and, according to the FIGS. 9 and 10, the motor has a single worm shaft which centrally drives an axle with two drive wheels. In a second configuration, the drive is mounted on a car with a motor having two worm shafts which, according to the FIGS. 12 and 13, each centrally drive a respective axle with two drive wheels. In a third configuration according to the FIG. 11, the motor is mounted in a vertical position underneath the car and utilizes a belt to drive an axle with two worms which in turn drive two oppositely running drive wheels displaced relative to one another.

The drive elements of motor, gear, axles and drive wheels described above must be mounted separately in all these configurations and must be assembled and coupled together during the installation. In that case, several axle bearings, couplings, supports and separately encapsulated gears must be mounted and aligned relative to one another. Such an installation in situ is time-consuming and, according to experience, accompanied by technical problems. The drives moreover do not show the brake required for elevator drives. Furthermore, worm gears do not have an optimum efficiency, which in effect requires more power and results in increased weight and costs.

SUMMARY OF THE INVENTION

The present invention concerns a drive unit for a self-propelled elevator car, which car travels along guide rails and is attached to a car-supporting structure. The drive unit includes: an axle tube; at least one rocker arm having one end attached to the axle tube and an opposite end pivotally attached to the car-supporting structure; at least one contact pressure means having one end connected to the axle tube and an opposite end pivotally connected to the car-supporting structure; a wheel shaft rotatably mounted in and extending coaxially through the axle tube; a pair of drive wheels each mounted on an associated end of the wheel shaft; a motor means coaxial with the wheel shaft, mounted on the axle tube and coupled to drive the wheel shaft in rotation; a speed-reducing gear coaxial with the wheel shaft and coupled between the motor means and the wheel shaft for driving the wheel shaft and the drive wheels in rotation; and a pair of support wheels rotatably mounted on the car-supporting structure whereby the contact pressure means draws the drive wheels and the support wheels against opposite sides of the guide rails to produce a frictional locking.

The drive unit also includes a brake means. In one embodiment, the brake means is an electromagnetic spring pressure disc brake mounted in the motor means coaxial with the wheel axle for selectively preventing rotation of said wheel axle. In another embodiment, the brake means is at least one shoe brake coupled between one of the drive wheels and the axle tube for preventing rotation of the wheel shaft and an actuator mounted on the motor means and connected to the shoe brake for selectively releasing the shoe brake to permit rotation of the wheel axle. The drive unit further can include an auxiliary drive mounted on the motor means for selectively rotating the wheel axle in case of a power failure.

It is an object of the present invention to create a drive unit for an elevator, which drive unit does not have the mentioned disadvantages of the prior art drives and in particular has a low weight. Such a drive unit is simple to manufacture at reasonable cost and can be preassembled as a complete unit without requiring special installation operations.

Another object of the present invention is to provide a drive unit in which the components are arranged in a common housing thereby reducing the cost to manufacture, achieving high operational reliability and reducing appreciably the unit weight.

Yet another object of the present invention is to optimize the overall efficiency of the drive unit in a small overall volume by driving two drive wheels from a single gear.

A further object of the present invention is to provide a relationship of the diameters of the drive wheel and the drive unit housing such that the installation and disassembly of the drive unit are facilitated thereby.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
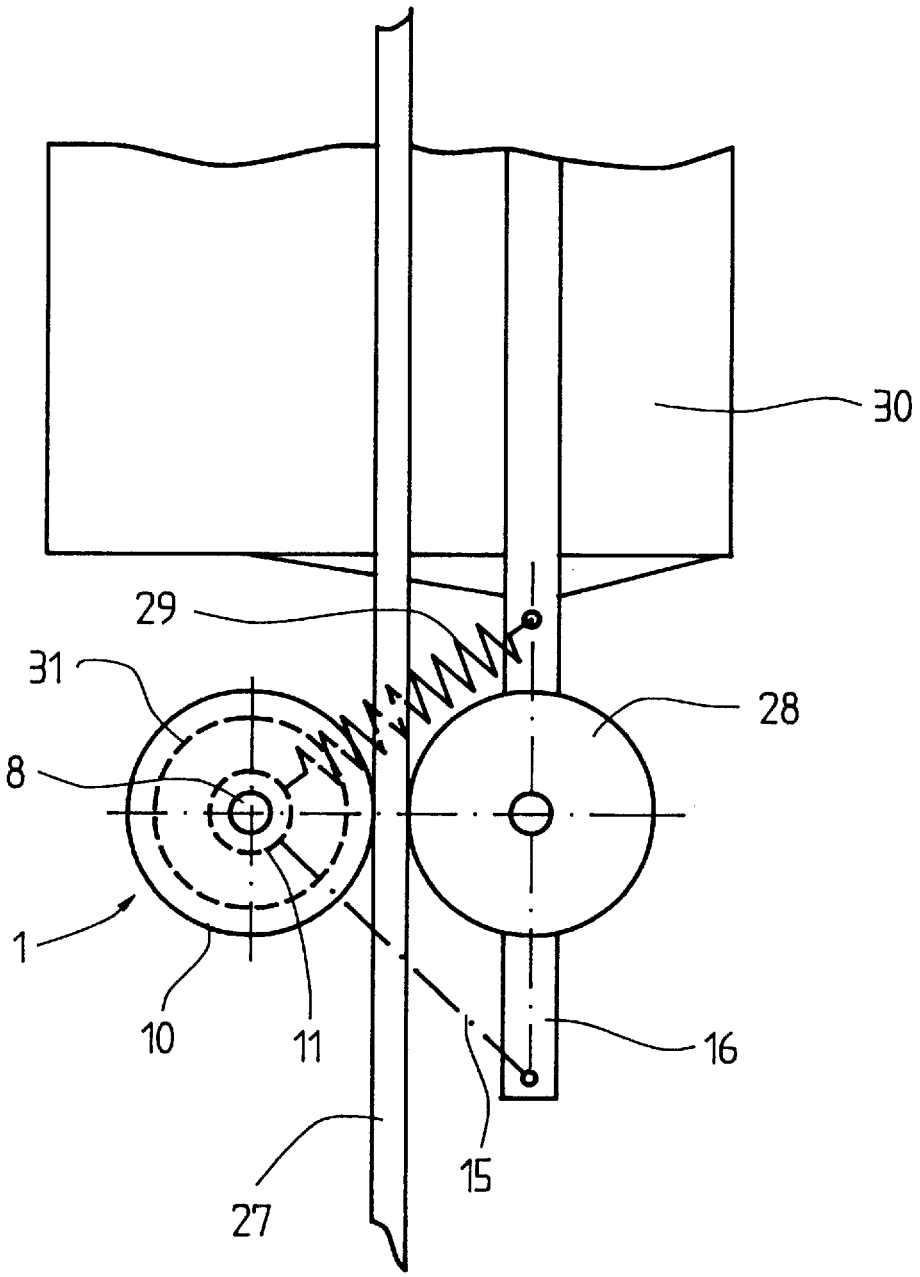
FIG. 1 is a fragmentary schematic side elevation view of an elevator drive unit in accordance with the present invention.

There is shown in the FIG. 1 an elevator car 30 attached to and supported by a car-supporting structure 16. A freely running support wheel 28 is rotatably mounted on a fixed axle attached to the car-supporting structure 16. A drive unit 1 is pivotally connected to the lower end of the car-supporting structure 16 by a rocker arm 15 having one end attached to a stationary axle tube 11 of the drive unit and an opposite end pivotally attached to the car-supporting structure. A drive wheel 10 is rotatably coupled to the drive unit 1 by a wheel shaft 8 extending through and coaxial with the axle tube 11. The drive wheel 10 is drawn against a generally vertically extending guide rail 27 by a contact pressure means in the form of a spring 29. The spring 29 extends at approximately a right angle to the rocker arm 15 and has one end connected to the axle tube 11 and an opposite end pivotally connected to the car-supporting structure 16 somewhat above the support wheel 28. The drive unit 1 includes a motor housing 31, smaller in diameter than the drive wheel 10 and coaxial with the axle tube 11 and the wheel shaft 8.

Figure 2:
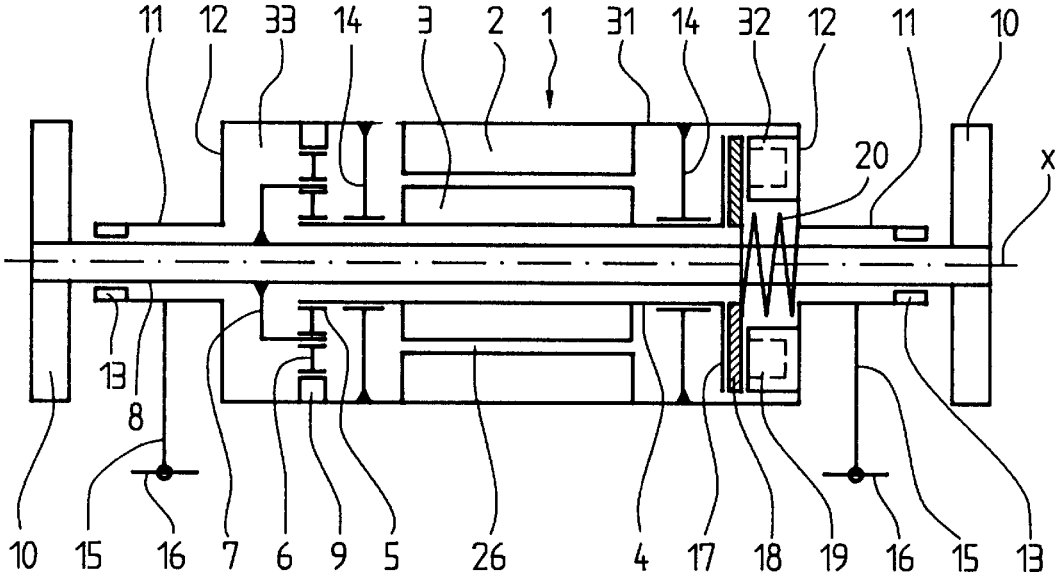
FIG. 2 is cross-sectional view of the drive unit shown in the FIG. 1.

The motor housing 31 is closed at both ends thereof by a pair of releasably attached motor flanges 12 as shown in the FIG. 2. The motor flanges 12 are each continued coaxially with a longitudinal axis "X" of the drive unit 1 externally to the left and the right forming sections of the axle tube 11, which sections each have a respective wheel shaft bearing 13 mounted in an outer end thereof. A stator 2 of an electrical motor is positioned in about the center of the motor housing 31 and is attached to an interior surface the housing wall. A pair of rotor shaft bearings 14 mounted in the housing 31 on opposite sides of the stator 2 rotatably support a rotor shaft 4. The rotor shaft 4 carries a rotor 3 longitudinally aligned and concentric with the stator 2 wherein an inductive operative connection with the stator is generated across a rotor air gap 26 between facing surfaces of the stator an the rotor. The rotor shaft 4 is constructed as a hollow shaft and is arranged co-axially about the wheel shaft 8. A toothed sunwheel 5 is mounted at the left-hand end of the rotor shaft 4 and a brake disc 17 is mounted the right-hand end thereof. The sunwheel 5 engages a plurality of planetary wheels 6 which in turn engage an encircling crown wheel 9 mounted inside the housing 31. The centers of the planetary wheels 6 are retained in their angular positions by a planetary wheel carrier 7 which is connected to the wheel shaft 8 to function as a drive output. The sunwheel 5, the planetary wheels 6 and the planetary wheel carrier 7 form a planetary gear 33 coaxial with the wheel shaft 8 which is driven by the electric motor at a rotational speed reduced from the rotational speed of the electric motor by the transmission ratio of the planetary gear.

A brake 32 in the form of an electromagnetic spring pressure disc brake is positioned on the right-hand side of the motor housing 31 coaxial with the wheel shaft 8. The brake 32 includes the brake disc 17, a brake plate 18, an electromagnet 19 and a spring 20 all concentric with the wheel shaft 8. The brake plate 18 is urged against the brake disc 17 in a rest position by the spring 20 which attached to the inner wall of the right-hand motor flange 12 to prevent rotation of the motor shaft 4. Upon electrical excitation of the circularly annular electromagnet 19, also attached to the inner wall of the right-hand motor flange 12 and encircling the spring 20, the brake plate 18 is retracted magnetically from the brake disc 17 to permit the motor shaft 4 to rotate freely. Also shown in the FIG. 2 is a connection of the drive unit 1 with the car-supporting structure 16 by a pair of the rocker arms 15. The wheel shaft 8 serves in common for mounting a pair of the drive wheels 10 and is constructed as one piece passing through the entire drive unit 1.

Figure 3:
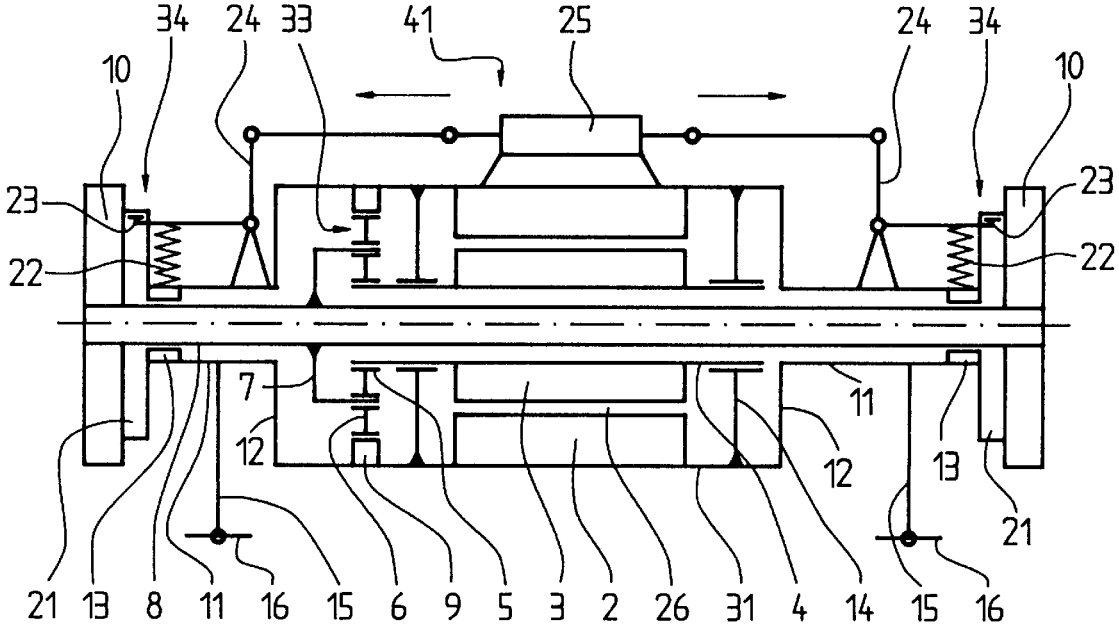
FIG. 3 is cross-sectional view of an alternate embodiment of the drive unit shown in the FIG. 1 having shoe brakes.

In the FIG. 3, there is shown an alternate embodiment drive unit 41 wherein a pair of shoe brakes 34 are provided at the drive wheels 10 in place of the spring pressure disc brake 32 shown in the FIG. 2. The drive wheels 10 each have a brake drum 21 attached thereto in which brake shoes 23 attached to the axle tube 11 are positioned. The brake shoes 23 are urged by means of springs 22 against a brake surface in the resting state. An actuator 25 is mounted on an exterior of the motor housing 31 and is connected to the brake shoes 23 by a linkage 24. When the actuator 25 is turned off, the brake shoes 23 are urged by spring pressure against the brake drum 21 to brake the drive wheels 10. When the actuator 25 is turned on, the linkage 24 is moved in the direction of the arrows to retract the brake shoes 23 from contact with the brake drums 21 and the drive wheels 10 are free to rotate.

Figure 4:
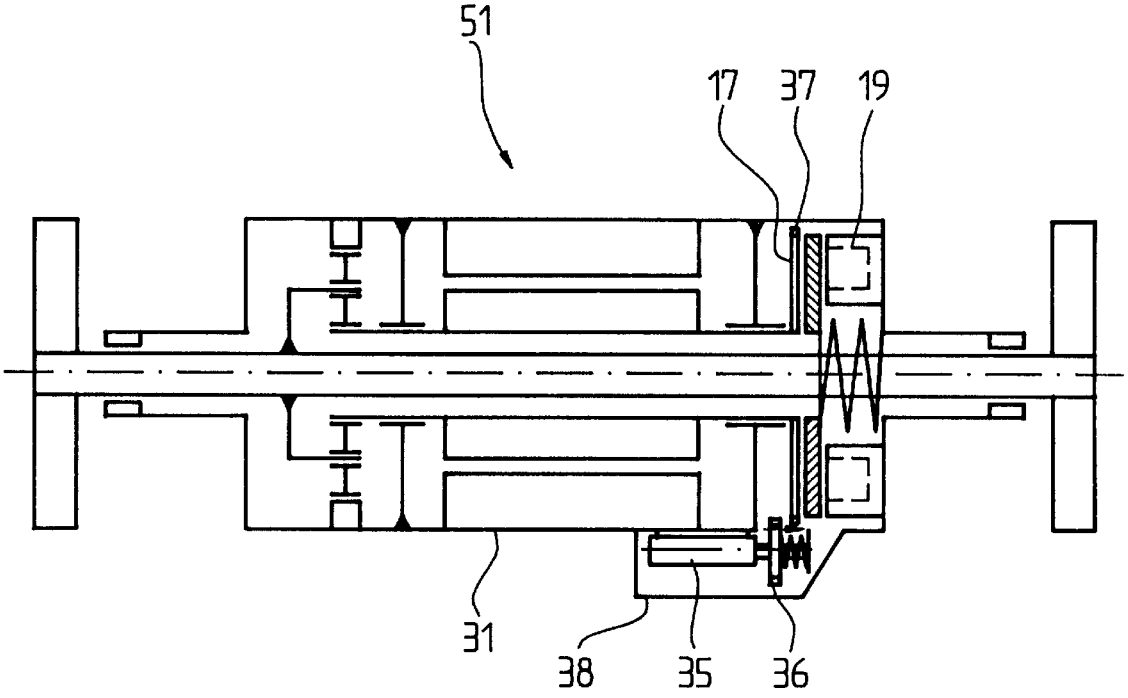
FIG. 4 is cross-sectional view of another alternate embodiment of the drive unit shown in the FIG. 1 having an auxiliary drive.

In the FIG. 4, there is shown another alternate embodiment drive unit 51 which is equipped with an auxiliary drive for an evacuation travel of the elevator car 30 in the case of a failure of electrical power to the motor of the drive unit. A starter motor 35 driving a starter pinion 36 in engagement with a gear wheel 37 serves as auxiliary drive. The starter motor 35 with the starter pinion 36 is mounted on the exterior of the motor housing 31 in an auxiliary drive housing 38. In the case of a power failure associated with an occupied car stopped between two floors, a not illustrated evacuation control becomes active, which activates the starter motor 35 and the brake release magnet 19. The starter pinion 36, which extends through an opening in the motor housing 31, is moved to the right by rotation of the starter motor 36 and engages the gear wheel 37 which is formed on a periphery of the brake disc 17. Thus, the auxiliary drive selectively rotates the wheel axle 8.

In the embodiments illustrated by way of example above, a typical planetary gear 33 is employed as a speed-reducing element for the sake of simplicity. However, any other type of gear can be used when both the following conditions are fulfilled: 1) The input and the output of the gear are arranged co-axially; and 2) The center of the gear has a passage for the wheel shaft 8 or can be provided with such a passage. Types of gears which can fulfill these conditions, possibly with adaptations, are, for example, "harmonic drive" gears or "CYCLO" gears.

Preferably, a frequency-regulated multiphase induction motor is used as the electric motor in the drive units 1, 41 and 51. In principle, however, practically any kind of electrical motor can be used and an hydraulic or a pneumatic motor also can be used.

The coaxial arrangement of the stator 2, the rotor 3, the air gap 26, the gear 33, the axle tube 11 and the wheel shaft 8 contribute to a saving of weight, and permit the brake 32 to be co-axially mounted in the motor housing 31. Through this arrangement, the drive units 1, 41 and 51 become compact and easily allow a modular mode of construction. The motor housing 31 with the attached motor flanges 12 and integral axle tubes 11 form a rigid supporting structure for the entire drive unit. The compact external dimensions of the motor housing 31 result in an external diameter which is smaller than that of the drive wheels 10. Thereby, the motor housing 31 can be attached to and supported by the car-supporting structure 16 on either the gear end or the brake end of the housing, and the motor flange 12 at the opposite end then can be removed and the drive unit serviced without a problem even when the car 30 is installed in the car-supporting structure. The attachment of the drive unit 1, 41 or 51 to the car-supporting structure 16 also permits the lifting-off or relief of the drive wheels 10 from the guide rail 27 and can be accomplished, for example, with a known car jack.

The rocker arms 15 can be connected either with the motor housing 31, with the motor flanges 12 or with the axle tubes 11. The pivot connection of the rocker arms 15 with the car-supporting structure 16 preferably includes a vibration-damping bearing sleeve (not shown).

The geometric arrangement of the rocker arm 15 and the spring 29 is not restricted to the configuration shown in the drawings. The fastening and pivot points of the spring 29 and the rocker arm 15 can be displaced downwardly or upwardly within certain limits according to contact pressure forces that are desired.

In summary, the drive unit (1,41,51) includes the axle tube (11), the rocker arms (15) each having one end attached to the axle tube (11) and an opposite end pivotally attached to the car-supporting structure (16) and the contact pressure means (29) each having one end connected to the axle tube (11) and an opposite end pivotally connected to the car-supporting structure (16). The wheel shaft (8) is rotatably mounted in and extends coaxially through the axle tube (11)

and has the pair of drive wheels (10) each mounted on an associated end thereof. The motor means (2,3,26,31) is coaxial with the wheel shaft (8), is mounted on the axle tube (11) and is coupled to drive the wheel shaft (8) in rotation through a speed-reducing gear (33) coaxial with the wheel shaft (8) and coupled between the rotor (3) and the wheel shaft (8). A pair of support wheels (28) are rotatably mounted on the car-supporting structure (16) whereby the contact pressure means (29) draws the drive wheels (10) and the support wheels (28) against opposite sides of the guide rails (27) to produce a frictional locking. A brake means (32) is mounted in the motor means (2,3,26,31) and is coaxial with the wheel axle (8) for selectively preventing rotation of the wheel axle (8). In another embodiment, a shoe brake means (34) is coupled between the drive wheels (10) and the axle tube (11) for preventing rotation of the wheel shaft (8) and an actuator (25) is mounted on the motor means (2,3, 26,31) and is connected to the shoe brake means (34) for selectively releasing the shoe brake means (34) to permit rotation of the wheel axle (8). In addition, an auxiliary drive (35,36,37) can be mounted on the motor means (2,3,26,31) for selectively rotating the wheel axle (8) in case of a power failure at the motor means (2,3,26,31).

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A drive unit (1,41,51) for rotatably driving drive wheels (10) of a self-propelled elevator car (30), which car travels along guide rails (27) and is attached to a car-supporting structure (16), comprising:

an axle tube (11) adapted to be connected to an elevator car-supporting structure (16);

a wheel shaft (8) rotatably mounted in and extending coaxially through said axle tube (11) and extending from opposite ends of said axle tube; and a motor means (2,3,26,31) coaxial with said wheel shaft (8), mounted on said axle tube (11) intermediate said opposite ends of said axle tube and coupled to drive said wheel shaft (8) in rotation.

2. The drive unit according to claim 1 including a speed-reducing gear (33) coaxial with said wheel shaft (8) and coupled between said motor means (2,3,26,31) and said wheel shaft (8) for driving said wheel shaft (8) in rotation.

3. The drive unit according to claim 1 including a pair of drive wheels (10) each mounted on an associated end of said wheel shaft (8).

4. The drive unit according to claim 3 including at least one shoe brake (34) coupled between one of said drive wheels (10) and said axle tube (11) for preventing rotation of said wheel shaft (8) and an actuator (25) mounted on said motor means (2,3,26,31) and connected to said one shoe brake (34) for selectively releasing said shoe brake (34) to permit rotation of said wheel axle (8).

5. The drive unit according to claim 3 including at least one contact pressure means (29) having one end connected to said axle tube (11) whereby when said axle tube (11) is connected to the elevator car-supporting structure (16) having a pair of support wheels (28) rotatably mounted thereon, an opposite end of said contact pressure means (29) is pivotally connected to the car-supporting structure (16) and said contact pressure means (29) draws said drive wheels (10) and said support wheels (28) against opposite sides of guide rails (27) to produce a frictional locking.

6. The drive unit according to claim 1 including at least one rocker arm (15) having one end attached to said axle tube (11) and an opposite end adapted to be pivotally attached to the car-supporting structure (16) and at least one contact pressure means (29) having one end connected to said axle tube (11) and an opposite end adapted to be pivotally connected to the car-supporting structure (16).

7. The drive unit according to claim 1 wherein said motor means (2,3,26,31) includes a motor housing (31) connected between a pair of sections of said axle tube (11).

8. The drive unit according to claim 1 including an auxiliary drive (35,36,37) mounted on said motor means (2,3,26,31) for selectively rotating said wheel axle (8).

9. The drive unit according to claim 1 including a brake means (32) mounted in said motor means (2,3,26,31) and coaxial with said wheel axle (8) for selectively preventing rotation of said wheel axle (8).

10. The drive unit according to claim 1 wherein said motor means (2,3,26,31) is a frequency-regulated induction motor.

11. A drive unit (1,41,51) for a self-propelled elevator car (30), which car travels along guide rails (27) and is attached to a car-supporting structure (16), comprising:

an axle tube (11) adapted to be connected to an elevator car-supporting structure (16);

a wheel shaft (8) rotatably mounted in and extending coaxially through said axle tube (11);

a pair of drive wheels (10) each mounted on an associated end of said wheel shaft (8);

a motor means (2,3,26,31) coaxial with said wheel shaft (8), mounted on said axle tube (11) and coupled to drive said wheel shaft (8) in rotation;

a speed-reducing gear (33) coaxial with said wheel shaft (8) and coupled between said motor means (2,3,26,31) and said wheel shaft (8) for driving said wheel shaft (8) and said drive wheels (10) in rotation;

at least one rocker arm (15) having one end attached to said axle tube (11) and an opposite end adapted to be pivotally attached to the car-supporting structure (16); and at least one contact pressure means (29) having one end connected to said axle tube (11) and an opposite end adapted to be pivotally connected to the car-supporting structure (16).

12. The drive unit according to claim 11 including a brake means (32) mounted in said motor means (2,3,26,31) and coaxial with said wheel axle (8) for selectively preventing rotation of said wheel axle (8).

13. The drive unit according to claim 11 including at least one shoe brake (34) coupled between one of said drive wheels (10) and said axle tube (11) for preventing rotation of said wheel shaft (8) and an actuator (25) mounted on said motor means (2,3,26,31) and connected to said one shoe brake (34) for selectively releasing said shoe brake (34) to permit rotation of said wheel axle (8).

14. The drive unit according to claim 11 including an auxiliary drive (35,36,37) mounted on said motor means (2,3,26,31) for selectively rotating said wheel axle (8).

15. The drive unit according to claim 11 including a pair of support wheels (28) whereby when said axle tube (11) is connected to the elevator car-supporting structure (16) and said support wheels (28) are rotatably mounted on said car-supporting structure (16), an opposite end of said contact pressure means (29) is pivotally connected to the car-supporting structure (16) and said contact pressure means (29) draws said drive wheels (10) and said support wheels (28) against opposite sides of guide rails (27) to produce a frictional locking.

16. A drive unit (1,41,51) for a self-propelled elevator car (30), which car travels along guide rails (27) and is attached to a car-supporting structure (16), comprising:

an elevator car-supporting structure (16);

an axle tube (11);

a pair of rocker arms (15) each having one end attached to said axle tube (11) and an opposite end pivotally attached to said car-supporting structure (16);

a pair of contact pressure means (29) each having one end connected to said axle tube (11) and an opposite end pivotally connected to said car-supporting structure (16);

a wheel shaft (8) rotatably mounted in and extending coaxially through said axle tube (11);

a pair of drive wheels (10) each mounted on an associated end of said wheel shaft (8);

a motor means (2,3,26,31) coaxial with said wheel shaft (8), mounted on said axle tube (11) and coupled to drive said wheel shaft (8) in rotation;

a speed-reducing gear (33) coaxial with said wheel shaft (8) and coupled between said motor means (2,3,26,31) and said wheel shaft (8) for driving said wheel shaft (8) and said drive wheels (10) in rotation; and a pair of support wheels (28) rotatably mounted on said car-supporting structure (16) whereby said contact pressure means (29) draws said drive wheels (10) and said support wheels (28) against opposite sides of guide rails (27) to produce a frictional locking.

17. The drive unit according to claim 11 including a brake means (32) mounted in said motor means (2,3,26,31) and coaxial with said wheel axle (8) for selectively preventing rotation of said wheel axle (8).

18. The drive unit according to claim 11 including at least one shoe brake (34) coupled between one of said drive wheels (10) and said axle tube (11) for preventing rotation of said wheel shaft (8) and an actuator (25) mounted on said motor means (2,3,26,31) and connected to said one shoe brake (34) for selectively releasing said shoe brake (34) to permit rotation of said wheel axle (8).

19. The drive unit according to claim 11 including an auxiliary drive (35,36,37) mounted on said motor means (2,3,26,31) for selectively rotating said wheel axle (8).

* * * * *